US007229159B2

(12) United States Patent
Chikamoto et al.

(10) Patent No.: US 7,229,159 B2
(45) Date of Patent: Jun. 12, 2007

(54) INK-JET HEAD

(75) Inventors: Tadanobu Chikamoto, Nagoya (JP); Atsushi Hirota, Nagoya (JP); Atsuo Sakaida, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 167 days.

(21) Appl. No.: 10/917,495

(22) Filed: Aug. 13, 2004

(65) Prior Publication Data

US 2005/0036017 A1 Feb. 17, 2005

(30) Foreign Application Priority Data

Aug. 14, 2003 (JP) ..... 2003-293433

(51) Int. Cl.
*B41J 2/05* (2006.01)

(52) U.S. Cl. ..... 347/65

(58) Field of Classification Search ..... 347/85, 347/86, 87, 93, 65
See application file for complete search history.

(56) References Cited

U.S. PATENT DOCUMENTS 5,808,643 A * 9/1998 Tracy et al. ..... 347/92
6,109,738 A * 8/2000 Miyata et al. ..... 347/71
6,634,742 B2 * 10/2003 Owaki et al. ..... 347/93
6,695,442 B2 2/2004 Kitahara
6,715,865 B2 * 4/2004 Yamaguchi et al. ..... 347/87

FOREIGN PATENT DOCUMENTS

JP A 6-255101 9/1994
JP 2000-033713 2/2000
JP 2000-296613 10/2000

* cited by examiner

*Primary Examiner*—Anh T. N. Vo
(74) *Attorney, Agent, or Firm*—Oliff & Berridge, PLC

(57) ABSTRACT

An ink-jet head comprises a reservoir unit that includes an ink reservoir. The reservoir unit includes an introduction passage that connects an ink introduction port and an inflow port facing the ink reservoir, and a filter that extends within the introduction passage. The introduction passage has such a configuration that, on both sides of the filter, ink can flow along the filter toward the inflow port. An ink non-passing area is formed within the reservoir unit. The ink non-passing area extends continuously, from at least a part of an area on a plane of the filter opposed to the inflow port, in a direction away from the inflow port.

16 Claims, 12 Drawing Sheets

INK-JET HEAD

BACKGROUND OF THE INVENTION

1. Field of the Invention

The present invention relates to an ink-jet head that ejects ink onto a record medium to thereby conduct a recording.

2. Description of Related Art

An ink-jet head is applicable to a recording apparatus such as printers and facsimile machines, etc. The ink-jet head comprises a plurality of nozzles, pressure chambers that communicate with the respective nozzles, an actuator that selectively applies ejection energy to ink contained in the pressure chambers, and the like. Ink is supplied from an ink supply source such as an ink tank, and then distributed among the respective pressure chambers. Upon driving of the actuator, the ink is ejected from the nozzles that communicate with the pressure chambers. According to one of known techniques, this type of ink-jet head comprises, for the purpose of stable ink supply to the pressure chambers, a reservoir that stores ink having supplied from the ink supply source and supplies the ink directly to the respective pressure chambers (see Japanese Published Unexamined Application No. Hei 6-255101).

In the aforementioned technique, the reservoir is provided with a filter that serves to remove foreign materials from ink, so that ink having no foreign materials can be supplied to the pressure chambers, without causing a clogging of the nozzles. However, since the filter blocks out air bubbles as well as foreign materials contained in the ink, the air bubbles stay on the filter, and growth of the air bubbles may cause a change in passage resistance of ink. When the passage resistance changes, ink ejection performance becomes unstable and therefore good image recordings cannot be performed. When the reservoir, even without any filter formed therein, includes a region where ink flows less smoothly, air bubbles stay within the region to cause unstable ejection performance.

SUMMARY OF THE INVENTION

An object of the present invention is to provide an ink-jet head in which air bubbles hardly stay within a reservoir.

According to a first aspect of the present invention, there is provided an ink-jet head comprising a passage unit and a reservoir unit. The passage unit includes a common ink chamber and a plurality of individual ink passages each extending from the common ink chamber through a pressure chamber to a nozzle. The reservoir unit is fixed to the passage unit and includes an ink reservoir which stores ink. The reservoir unit includes an introduction passage, one or more discharge passages, and a filter. The introduction passage connects an ink introduction port into which ink is introduced and an inflow port which faces the ink reservoir. The one or more discharge passages communicate the ink reservoir with the common ink chamber. The filter extends along a plane within the introduction passage so as to divide the introduction passage into an upper passage and a lower passage. The introduction passage has such a configuration that, on both sides of the filter, ink can flow along the filter toward the inflow port. An ink non-passing area is formed within the reservoir unit. The ink non-passing area extends continuously, from at least a part of an area on the plane opposed to the inflow port, in a direction away from the inflow port.

With the foregoing construction, since the passage unit is supplied with ink from which foreign materials have already been removed by the filter, a clogging of the nozzle can be prevented. At the same time, moreover, the ink non-passing area is formed at a portion where air bubbles tend to stay. Thus, stay of air bubbles can be prevented.

According to a second aspect of the present invention, there is provided an ink-jet head comprising a passage unit and a reservoir unit. The passage unit includes a common ink chamber and a plurality of individual ink passages each extending from the common ink chamber through a pressure chamber to a nozzle. The reservoir unit is fixed to the passage unit and includes an ink reservoir which stores ink. The reservoir unit includes an introduction passage, one or more discharge passages, and a filter. The introduction passage connects an ink introduction port into which ink is introduced and an inflow port which faces the ink reservoir. The one or more discharge passages communicate the ink reservoir with the common ink chamber. The filter extends along a plane within the introduction passage so as to divide the introduction passage into an upper passage and a lower passage. The introduction passage has such a configuration that, on both sides of the filter, ink can flow along the filter toward the inflow port. A cross-sectional area of the lower passage, with respect to a plane perpendicular to an inkflow running along the filter toward the inflow port, is smallest at its portion adjacent to the inflow port.

With the foregoing construction, a cross-sectional area of the lower passage with respect to the above-described plane is smallest at its portion adjacent to the inflow port, thereby ink velocity rises at a downstream of the inkflow within the lower passage. This causes large suction force from the upper passage to the lower passage, so that not only ink but also air bubbles can easily be brought into the lower passage. Accordingly, air bubbles are prevented from staying on the filter. In addition, an attempt to raise ink velocity by reducing the cross section of the passage often results in increased pressure loss and thus insufficient ink supply to the passage unit. According to the foregoing construction, however, ink velocity can be raised simultaneously with suppressing increase in pressure loss.

According to a third aspect of the present invention, there is provided an ink-jet head comprising a passage unit and a reservoir unit. The passage unit includes a common ink chamber and a plurality of individual ink passages each extending from the common ink chamber through a pressure chamber to a nozzle. The reservoir unit is fixed to the passage unit and includes an ink reservoir which stores ink. The reservoir unit includes an introduction passage, one or more discharge passages, and a filter. The introduction passage connects an ink introduction port into which ink is introduced and an inflow port which faces the ink reservoir. The one or more discharge passages communicate the ink reservoir with the common ink chamber. The filter extends along a plane within the introduction passage so as to divide the introduction passage into an upper passage and a lower passage. The introduction passage has such a configuration that, on both sides of the filter, ink can flow along the filter toward the inflow port. The filter has lower filtration resistance at its portion nearer to the inflow port.

With the foregoing construction, since the filter has lower filtration resistance at its portion nearer to the inflow port, ink velocity rises at a downstream of the inkflow within the upper passage. As a result, not only ink but also air bubbles can easily be brought into the lower passage. Accordingly, air bubbles are prevented from staying on the filter.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, some preferred embodiments of the present invention will be described with reference to the accompanying drawings.

Figure 1:
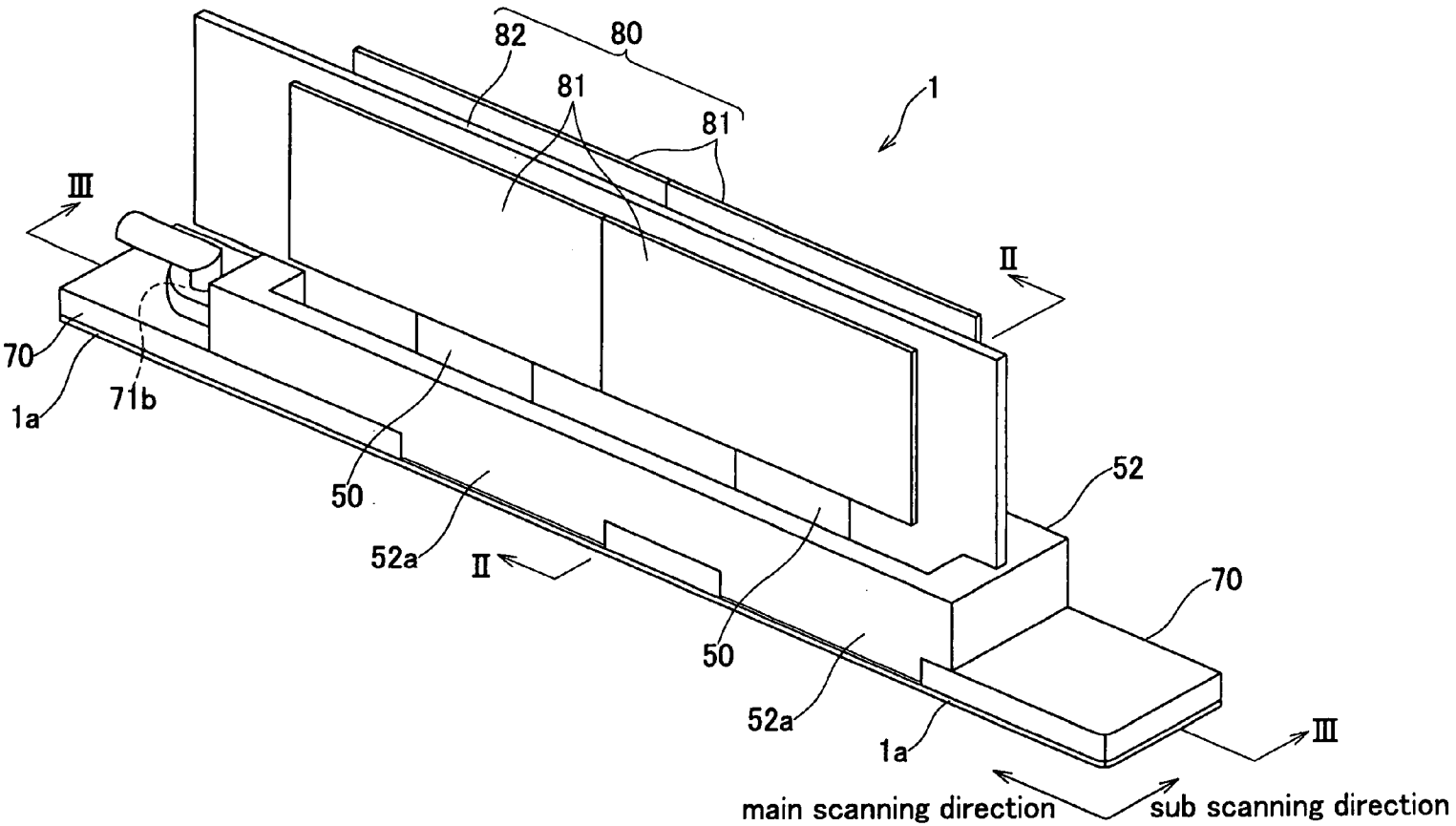
FIG. 1 is a perspective view of an ink-jet head according to a first embodiment of the present invention.
Figure 2:
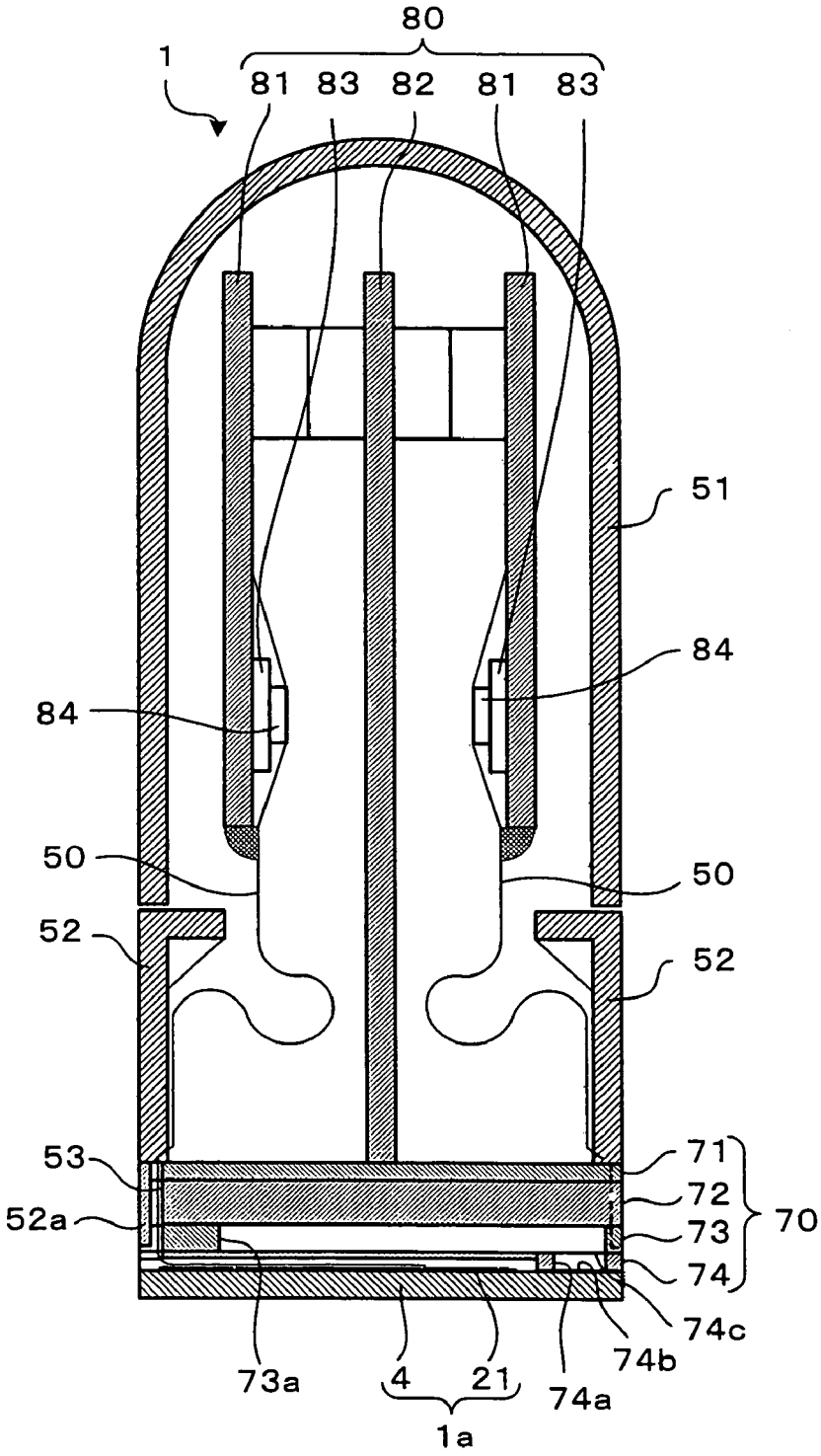
FIG. 2 is a sectional view taken along a line II—II of FIG. 1.

First, a description will be given to an ink-jet head according to a first embodiment of the present invention. As illustrated in FIG. 1, an ink-jet head 1 of this embodiment has a shape elongated in a main scanning direction, and comprises, from a bottom side, a head main body 1*a*, a reservoir unit 70 (not shown in FIG. 1; see FIG. 2), and a control unit 80 that controls driving of the head main body 1*a*. As illustrated in FIG. 2, an upper covering 51 and a lower covering 52 are provided for the purpose of protecting against ink an upper part of the head including the control unit 80 and a lower part thereof including the reservoir unit 70, respectively. An illustration of the upper covering 51 is omitted from FIG. 1 so that the control unit 80 may be exposed into a visible state.

Here, referring to FIGS. 1 and 2, a construction of the control unit 80 will be described.

The control unit 80 includes a main substrate 82, two sub substrates 81 disposed on both sides of the main substrate 82, and driver ICs 83 (see FIG. 2) each fixed to a side face of each sub substrate 81 confronting the main substrate 82.

The main substrate 82, whose plane extends in a vertical direction and in the main scanning direction, has a rectangular shape elongated in the main scanning direction and is perpendicularly fixed onto the reservoir unit 70. The two sub substrates 81 are laid in parallel with the main substrate 82, and disposed on both sides of the main substrate 82 to be equidistantly spaced apart therefrom. The two sub substrates 81 are electrically connected with the main substrate 82. The driver ICs 83 (see FIG. 2) generate signals for driving the actuator unit 21 that is included in the head main body 1*a*. A heat sink 84 is fixed to a face of each driver IC 83 confronting the main substrate 82.

The sub substrate 81 and the driver IC 83 fixed to each other make a pair, and each pair is electrically connected with an FPC 50 acting as a power supply member. The FPC 50 is, at its one end, connected with the actuator unit 21, too, so that the FPC 50 transmits to the driver IC 83 a signal outputted from the sub substrate 81, and feeds to the actuator unit 21 a drive signal outputted from the driver IC 83.

The upper covering 51 and the lower covering 52 will then be described.

As illustrated in FIG. 2, the upper covering 51 is a housing with an arched ceiling. The upper covering 51 covers the sub substrates 81 and an upper portion of the main substrate 82.

The lower covering 52 is a substantially rectangular-cylindrical housing that is opened out in its upper side and lower side. The lower covering 52 covers upwardly-extended portions of the FPCs 50. Within a space covered by the lower covering 52, the FPCs 50 are laid in a loose manner in order to avoid stress put thereon.

At a top of the lower covering 52, ends of its sidewalls are bent at approximately 90 degrees to thereby form a horizontal level. On a joint portion of this horizontal level with the sidewall, placed is a lower open end of the upper covering 51.

Each sidewall of the lower covering 52 (only one of which is visible in FIG. 1) has, at its bottom end, two protrusions 52*a* protruding downward. The two protrusions 52*a* are disposed side by side along a lengthwise direction of the sidewall. Each protrusion 52*a* covers a portion of the FPC 50 disposed within a groove 53 of the reservoir unit 70, and at the same time the protrusions 52*a* are themselves received within the grooves 53 of the reservoir unit 70, as illustrated in FIG. 2. A tip end of the protrusion 52*a* confronts the passage unit 4 included in the head main body 1*a* with a certain clearance formed therebetween for absorbing manufacture errors. A silicone resin, etc., is packed into this clearance which is thereby sealed up. Except for the protrusions 52*a*, the bottom ends of the sidewalls of the lower covering 52 are disposed above the reservoir unit 70.

As illustrated in FIG. 2, one end portion of the FPC 50 connected with the actuator unit 20 horizontally extends in a plane of the passage unit 4. Each FPC 50 is, while forming a bent portion in its midway, upwardly extended out through the groove 53 of the reservoir unit 70, so that the other end of the FPC 50 can be connected with the corresponding pair of sub substrate 81 and driver IC 83 of the control unit 80.

Both of the lower covering 52 and the upper covering 51 have substantially the same width as that of the passage unit 4.

Figure 3:
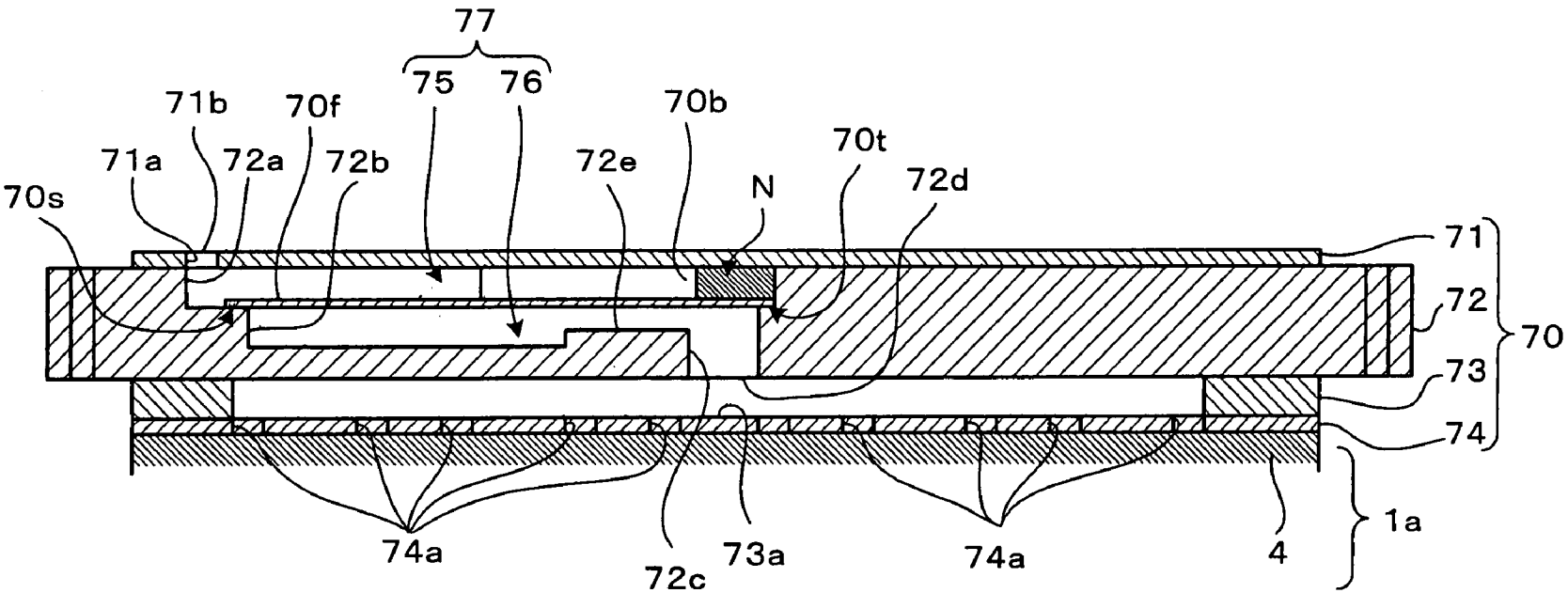
FIG. 3 is a sectional view of a reservoir unit taken along a line III—III of FIG. 1.

Then, referring to FIGS. 2, 3, and 4, a description will be given to a construction of the reservoir unit 70. For the purpose of explanatory convenience, FIG. 3 is drawn on an enlarged scale in the vertical direction.

The reservoir unit 70 has a layered structure of four plates, i.e., an upper plate 71, a filter plate 72, a reservoir plate 73, and an under plate 74. Each of the four plates 71 to 74 has a plane of substantially rectangular shape elongated in the main scanning direction (see FIG. 1).

Figure 4:
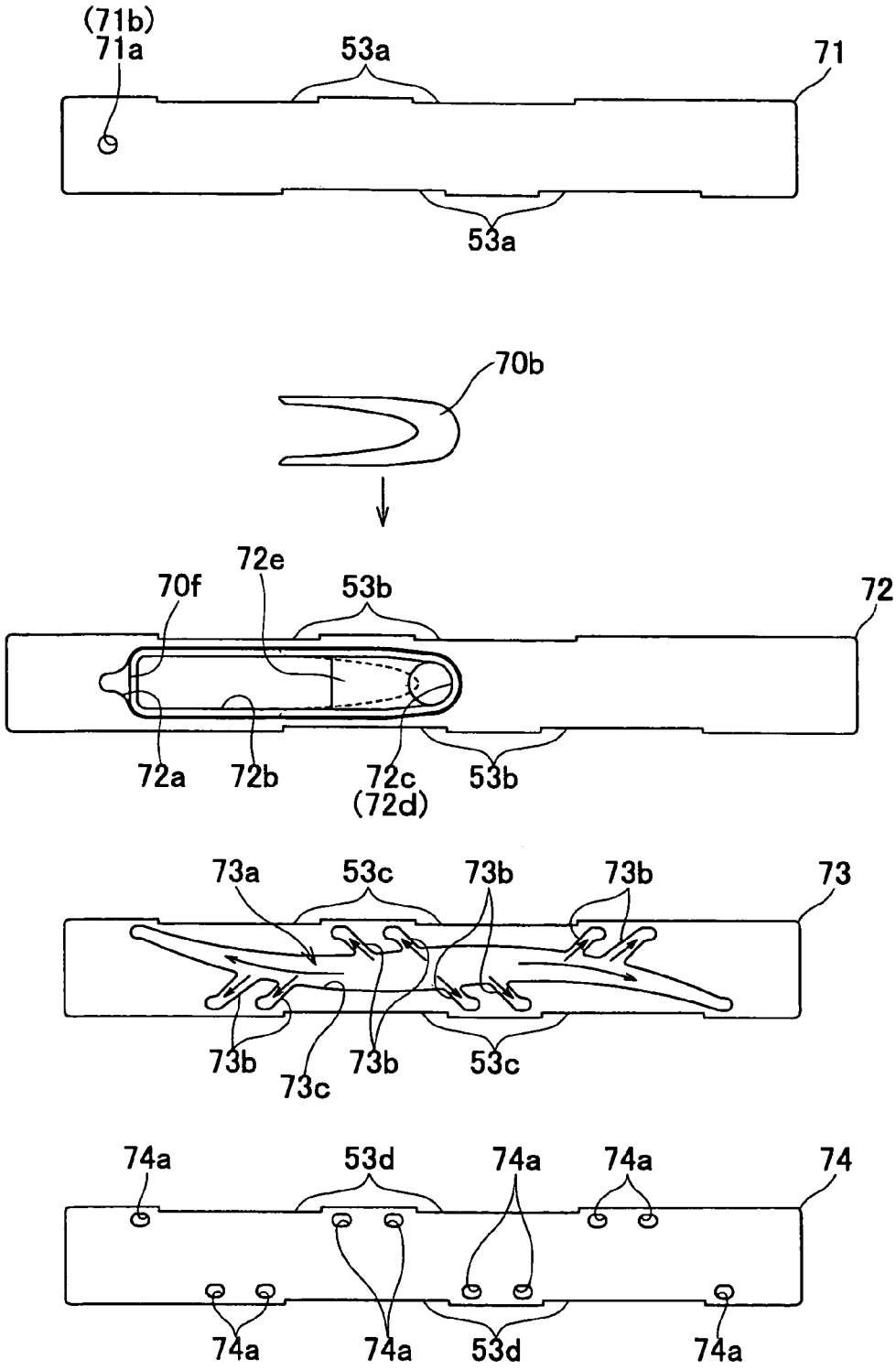
FIG. 4 is an exploded plan view of the reservoir unit illustrated in FIG. 3.

As illustrated in FIG. 4, the four plates 71, 72, 73, and 74 have, at their both widthwise ends, a total of four rectangular notches 53*a*, 53*b*, 53*c*, and 53*d*, respectively. At each widthwise end of each plate, two notches are formed side by side along a lengthwise direction of the plate. The four notches are arranged in a staggered pattern. These notches 53*a* to 53*d* are aligned with one another in the vertical direction to thereby form a groove 53 (see FIG. 2) that has a rectangular shape in a plan view and penetrates through the reservoir unit 70 in the vertical direction. Thus, two grooves 53 are formed on each side face of the reservoir unit 70 relative to its widthwise direction, that is, a total of four grooves 53 are formed on its side faces. The four grooves 53 are arranged apart from one another in a staggered pattern along the length of the reservoir unit.

At one lengthwise end of the upper plate 71, a substantially circular hole 71*a* is formed in the middle of the width by means of etching, etc. The hole 71*a* penetrates through the upper plate 71 in its thickness direction, so that an ink introduction port 71*b* can be opened in a top face of the upper plate 71.

In a top face of the filter plate 72, as illustrated in FIG. 3, a first recess 72*a* is formed to have a depth of approximately one-third of a thickness of the filter plate 72. As illustrated in FIG. 4, the first recess 72*a* is, in a plan view, elongated from a portion corresponding to the hole 71*a* to a center of the filter plate 72. A portion of the first recess 72*a* corresponding to the hole 71*a* is shaped in conformity with a shape of the hole 71*a*, and a portion of the first recess 72*a* locating at the center of the filter plate 72 is shaped in conformity with a shape of a hole 72*c*.

In the filter plate 72, further, a second recess 72*b* is formed under the first recess 72*a*. The second recess 72*b* has substantially the same shape as that of the first recess 72*a*, but the second recess 72*b* is somewhat smaller than the first recess 72*a* in a plan view. Steps 70*s* and 70*t* are formed at a boundary between the first recess 72*a* and the second recess 72*b*. These steps 70*s* and 70*t* support thereon an outer edge portion of a filter 70*f* that serves to remove dust and dirt contained in ink. The filter 70*f* has substantially the same shape as that of an area of the first recess 72*a* except for the portion corresponding to the hole 71*a*. The filter 70*f* is slightly smaller than this area in a plan view. The filter 70*f* has lower filtration resistance at its portion nearer to an inflow port 72*d* which will be described later.

As for a depth of the second recess 72*b*, a position corresponding to, from one longitudinal end, approximately two-third of a length of the second recess 72*b* defines a boundary, on the one end side of which its depth is approximately one-third of the entire thickness of the plate 72, and on a center side of which its depth is approximately one-sixth of the entire thickness of the plate 72. Thus, a protrusion 72*e* appears on a portion of a bottom face of the second recess 72*b* near the hole 72*c*.

At almost the center of the filter plate 72, a substantially circular hole 72*c* is formed to penetrate through the filter plate 72 in its thickness direction. The hole 72*c* communicates with the first and second recesses 72*a* and 72*b*, and at the same time forms an inflow port 72*d* opening out in a lower face of the plate 72.

The inflow port 72*d* is disposed at a position corresponding in a plan view to a center of a later-described ink reservoir 73*a* with respect to its elongated direction (which will hereinafter be referred to simply as a "center of the ink reservoir 73*a*"). The inflow port 72*d* faces the ink reservoir 73*a*, and at the same time confronts a later-described main passage 73*c* of the ink reservoir 73*a*. In a plane of the filter 70*f*, a location of an area opposed to the inflow port 72*d* is shifted away from a location of an area opposed to the ink introduction port 71*b*.

A U-shaped block 70*b* as shown in FIG. 4 is disposed on the filter 70*f*. The block 70*b* with two tapered tip ends has such a configuration as to conform with an almost half part of a sidewall of the first recess 72*a*, so that the block 70*b* is fitted into the recess 72*a*. The block 70*b* is disposed with its curved portion being above the hole 72*c* and with its two tip ends directed toward one longitudinal end. In other words, the two tip ends of the block 70*b* are directed toward an upstream of inkflow above the filter 70*f*, and the curved portion thereof is directed toward a downstream of the inkflow.

The block 70*b* forms an ink non-passing area N (see FIG. 3). In a plan view, as illustrated in FIG. 4, the non-passing area N does not wholly but partially overlap the inflow port 72*d*. As illustrated in FIG. 3, the non-passing area N extends vertically upward, continuously from a portion on the plane of the filter 70*f* including a point furthest from the ink introduction port 71*b* within the area opposed to the inflow port 72*d*.

An ink reservoir 73*a* that stores ink is formed in the reservoir plate 73 by press working, etc. The ink reservoir 73*a* penetrates through the reservoir plate 73 in its thickness direction. In a plan view, as illustrated in FIG. 4, the ink reservoir 73*a* curvedly extends in the main scanning direction while tapering toward its lengthwise ends, and at the same time the ink reservoir 73*a* is point-symmetrical with respect to a center thereof.

The ink reservoir 73*a* is made up of a main passage 73*c* that extends in the main scanning direction, and branch passages 73*b* that branch from the main passage 73*c*. A passage width of each branch passage 73*b* is narrower than that of the main passage 73*c*. Among the branch passages 73*b*, every two branch passages 73*b* extending in the same direction make a pair. Two pairs of branch passages 73*b* running in different directions from each other are extended out from each widthwise end of the main passage 73*c*. The two pairs of branch passages 73*b* are spaced apart from each other along the elongated direction of the main passage 73*c*. The four pairs branch passages 73*b* are disposed in a staggered pattern.

In the ink reservoir 73*a*, both lengthwise ends of the main passage 73*c* and ends of the respective branch passages 73*b* correspond to portions of the under plate 74 where holes 74*a* are formed.

Ten holes 74*a* in total are formed in the under plate 74 by etching, etc. Each of the holes 74*a* has a substantially circular shape and penetrates through the under plate 74 in its thickness direction. Five holes 74*a* are disposed near each widthwise end of the under plate 74 in a staggered pattern along the lengthwise direction, and the holes 74*a* are disposed point-symmetrically with respect to the center of the ink reservoir 73*a*. More specifically, along one widthwise end of the under plate 74, one hole 74*a*, two holes 74*a*, and two holes 74*a* are spacedly disposed in this order from one side in the lengthwise direction. Along the other widthwise end of the under plate 74, one hole 74*a*, two holes 74*a*, and two holes 74*a* are spacedly disposed in this order from the other side in the lengthwise direction. The ink holes 74*a* are so disposed as to keep away from the notches 53*d*. In other words, each hole 74*a* is disposed between two neighboring notches 53*d*.

When the four plates 71 to 74 are positioned relative to one another and put in layers, an ink passage as shown in FIGS. 3 and 4 is formed within the reservoir unit 70.

Herein, a passage connecting the ink introduction port 71*b* and the inflow port 72*d* is referred to as an introduction passage 77, and a passage communicating the ink reservoir

73*a* with a manifold channel 5 is referred to as a discharge passage. The filter 70*f* divides the introduction passage 77 into an upper passage 75 and a lower passage 76. The introduction passage has such a configuration that, on both sides of the filter 70*f*, ink can flow along the filter 70*f* toward the inflow port 72*d*. The upper passage 75 is constituted of the first recess 72*a* located above the filter 70*f*. The lower passage 76 is constituted of the second recess 72*b* and the hole 72*c* both located under the filter 70*f*.

As illustrated in FIG. 3, a portion of the lower passage 76 above the protrusion 72*e* becomes narrower. In other words, a cross-sectional area of the lower passage 76, with respect to a plane perpendicular to the inkflow running along the filter 70*f* toward the inflow port 72*d*, i.e., with respect to a vertical plane perpendicular to the drawing sheet of FIG. 3, is smallest at its portion adjacent to the inflow port 72*d*.

The ink reservoir 73*a* extends in parallel to the plane of the filter 70*f*. Each discharge passage is a cylindrical passage formed within the hole 74*a* of the under plate 74 and extending in the vertical direction.

Next, an inkflow within the reservoir unit 70 will be described.

Ink having supplied from an ink supply source (not illustrated) such as an ink tank is, via, e.g., a tube (not illustrated) inserted into the hole 71*a*, introduced into the ink introduction port 71*b*, and then runs vertically downward to flow into one end of the upper passage 75. In the upper passage 75, the ink flows along the filter 70*f* toward the inflow port 72*d*, and passes through the filter 70*f* except for its portion corresponding to the non-passing area N, and thereafter the ink flows into the lower passage 76. In the upper passage 75, an inkflow is formed to avoid the block 70*b*, and more specifically, the ink flows from the two tip ends of the block. 70*b* toward the curved portion thereof. In the lower passage 76, the ink flows along the filter 70*f* toward the inflow port 72*d*, around which the ink flows vertically downward. Then, the ink flows through the inflow port 72*d* into the ink reservoir 73*a*.

As shown by arrows in FIG. 4, the ink flown through the inflow port 72*d* into the center of the ink reservoir 73*a* then spreads from a center of the main passage 73*c* toward the ends of the respective branch passages 73*b* as well as toward the ends of the ink reservoir 73*a* in the elongated direction thereof. The ink is temporarily stored within the ink reservoir 73*a*, and subsequently passes through the discharge passages formed within the respective holes 74*a*, to be thereafter supplied via the ink receiving ports 5*b* (see FIG. 5) into the passage unit 4. As illustrated in FIG. 2, a bottom of the under plate 74 has been processed by half etching, etc., so that only a periphery of each hole 74*a* can protrudes downward. Since the holes 74*a* are formed in the under plate 74 in the staggered pattern (see FIG. 4) as mentioned above, protrusions formed on the bottom of the under plate 74 are also arranged in a staggered pattern. The reservoir unit 70 is fixed to the top face of the passage unit 4 such that it can be in contact with the passage unit 4 only at the protrusions of the under plate 74 formed around the holes 74*a* and its portions other than the protrusions can be spaced apart from the passage unit 4.

As illustrated in FIG. 2, except for the grooves 53, widthwise ends of the reservoir unit 70 are aligned with widthwise ends of the passage unit 4 in the vertical direction. In addition, a total width of the reservoir unit 70 including the lower covering 52 is substantially the same as the width of the passage unit 4.

Then, a description will be given to a construction of the head main body 1*a* with reference to FIGS. 2, 5, 6, 7, 8, 9A, and 9B. In FIG. 6, for the purpose of explanatory convenience, pressure chambers 10 and apertures 12 are illustrated with solid lines though they locate below the actuator units 21 and therefore should be illustrated with broken lines.

Figure 5:
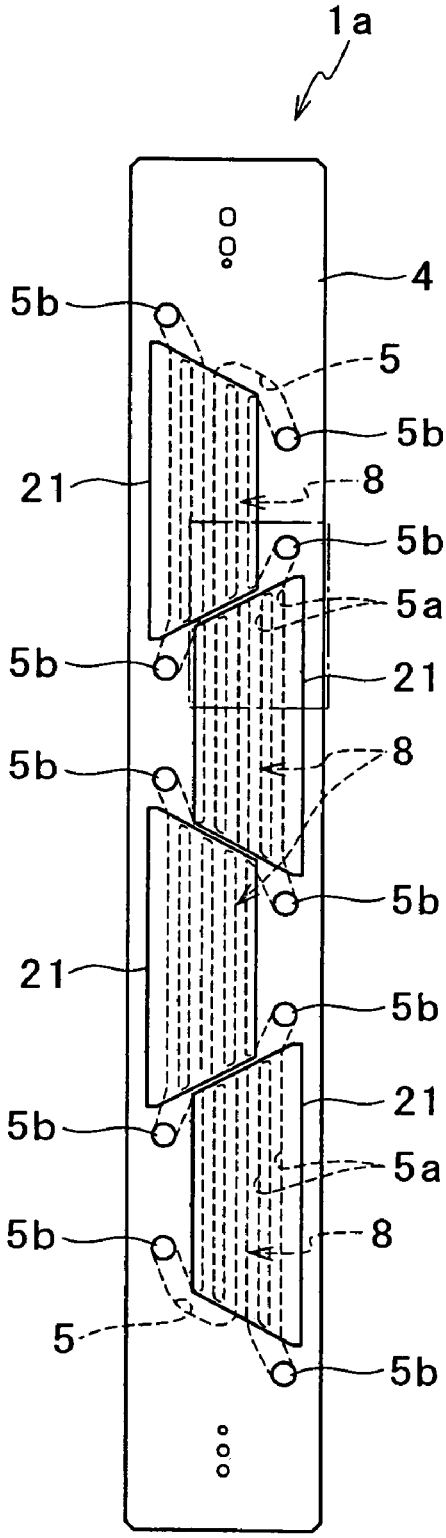
FIG. 5 is a plan view of a head main body illustrated in FIG. 1.
Figure 6:
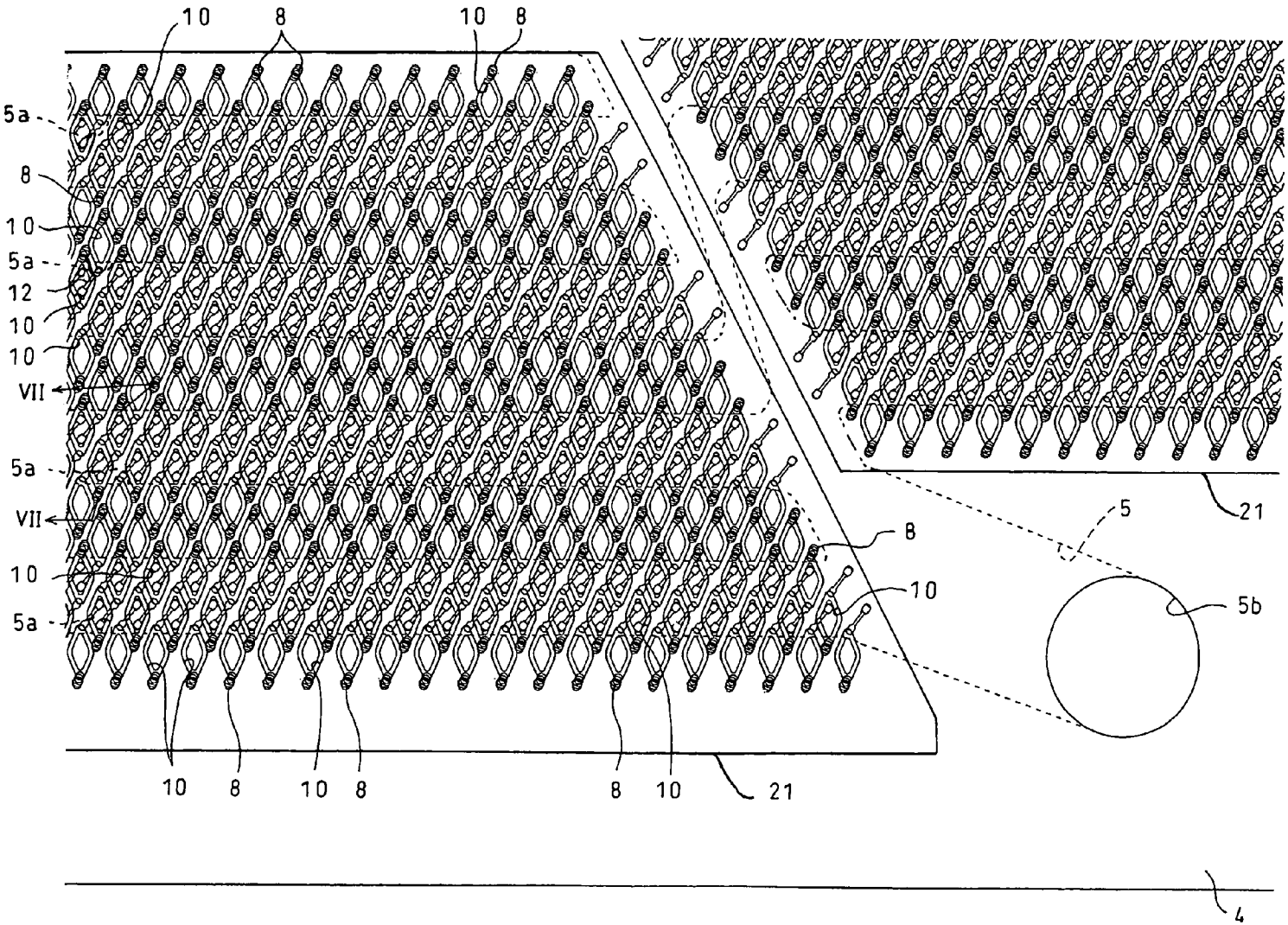
FIG. 6 is an enlarged view of a region enclosed with an alternate long and short dash line in FIG. 5.

As illustrated in FIGS. 2 and 5, the head main body 1*a* includes the substantially rectangular parallelepiped passage unit 4, and four actuator units 21 fixed to the top face of the passage unit 4. The plane of the passage unit 4 has substantially the same shape and the same size as those of a plane of the reservoir unit 70 except for the grooves 53. The actuator units 21 serve to selectively apply ejection energy to ink contained in the pressure chambers 10 that are formed in the passage unit 4. The actuator units 21 are fixed on such areas of the top face of the passage unit 4 as to spacedly confront the reservoir unit 70. The actuator units 21 are out of contact with the reservoir unit 70 and spaced apart therefrom.

As illustrated in FIG. 5, the four actuator units 21 each having a trapezoidal shape in a plan view are arranged on the top face of the passage unit 4 in a staggered pattern. The actuator units 21 are disposed such that parallel opposed sides of each actuator unit 21 may extend along a lengthwise direction of the passage unit 4 and oblique sides of every neighboring actuator units 21 may overlap each other in a widthwise direction of the passage unit 4. The four actuator units 21 have such a relative positional relationship that they may locate equidistantly on opposite sides of a widthwise center of the passage unit 4.

As illustrated in FIGS. 5 and 6, an under face of the passage unit 4 provides ink ejection regions where a large number of nozzles 8 are formed in a matrix. A total of ten substantially circular ink receiving ports 5*b* are formed in areas of the top face of the passage unit 4 having no actuator unit 21 bonded thereon, i.e., in areas of the top face of the passage unit 4 fixed to the reservoir unit 70. The ink receiving ports 5*b* are opposed to the respective holes 74*b* (see FIGS. 3 and 4) of the reservoir unit 70.

Figure 7:
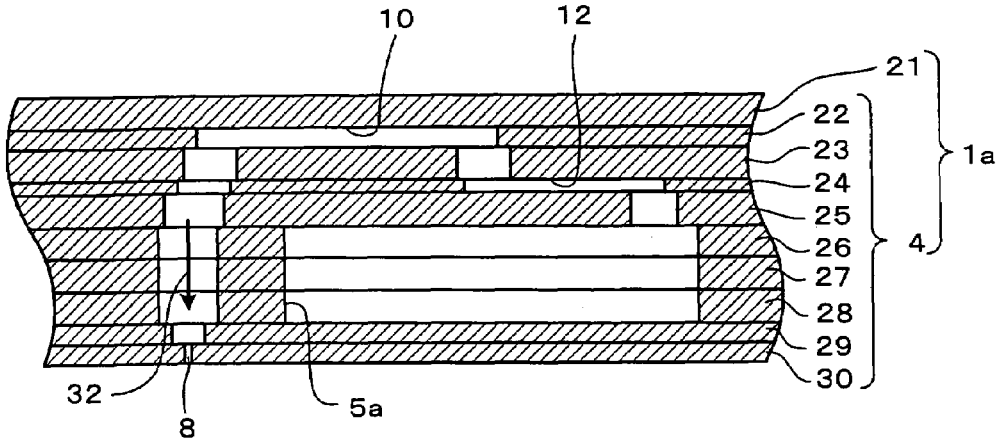
FIG. 7 is a local sectional view taken along a line VII—VII of FIG. 6.

The passage unit 4 also includes manifold channels 5 that communicate with the ink receiving ports 5*b*, sub-manifold channels 5*a* that branch from the corresponding manifold channels 5 (see FIGS. 5 and 6), and individual ink passages 32 as shown in FIG. 7 each corresponding to each nozzle 8. Ink is introduced from the reservoir unit 70 into the ink receiving ports 5*b* of the passage unit 4, and then branches from the manifold channels 5 into the respective sub-manifold channels 5*a*, to reach the tapered nozzles 8 via the apertures 12 and the pressure chambers 10. The aperture 12 functions as a throttle.

As illustrated in FIG. 6, the pressure chambers 10 each having a substantially rhombic shape in a plan view are, similarly to the nozzles 8, arranged in a matrix within the respective ink ejection regions.

Figure 8:
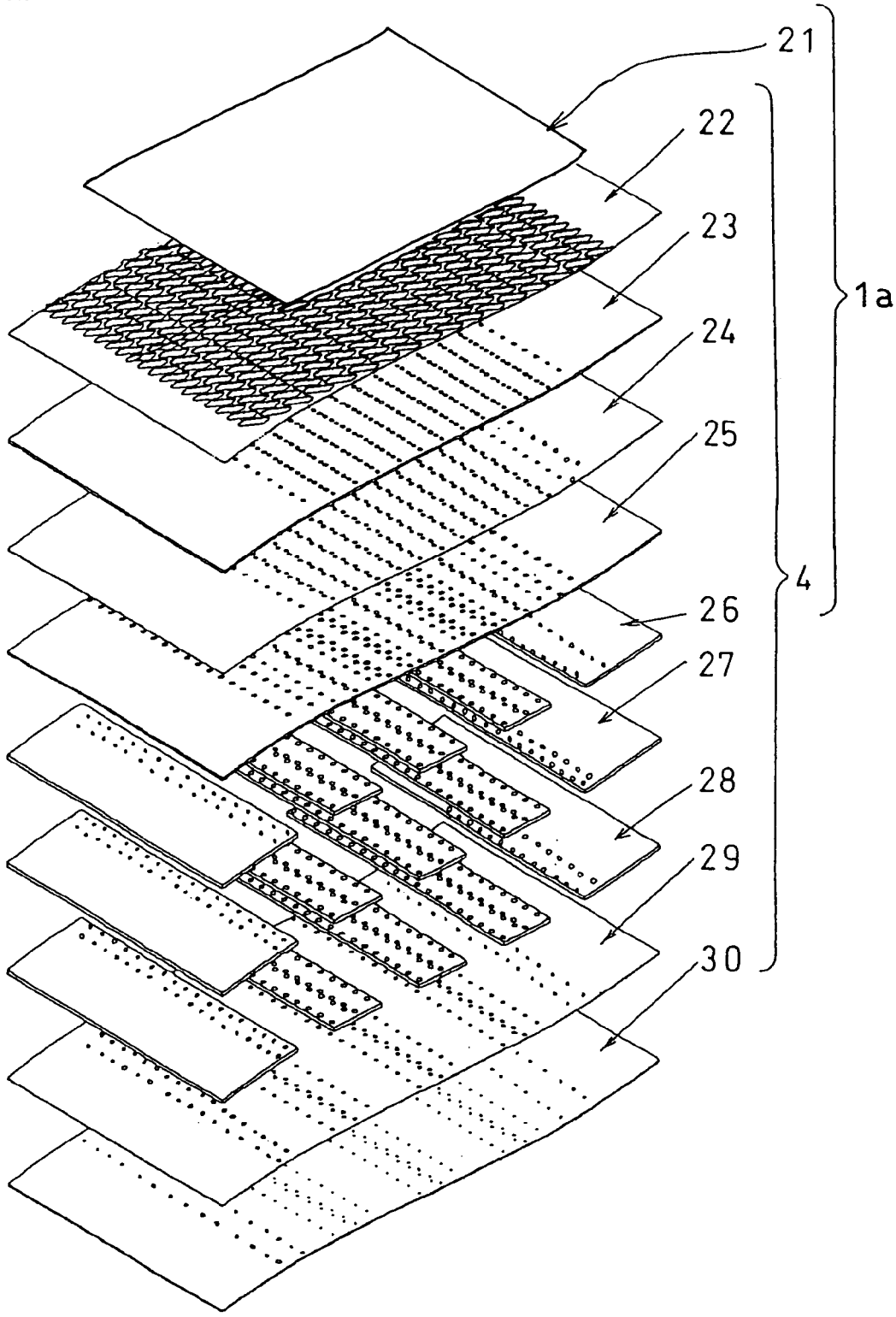
FIG. 8 is a local exploded perspective view of the head main body illustrated in FIG. 1.

Nine metal plates are positioned relative to one another and put in layers so as to form the aforementioned individual ink passages 32, thereby constituting the passage unit 4 (see FIGS. 7 and 8). More specifically, the passage unit 4 is made up of, from a top side, a cavity plate 22, a base plate 23, an aperture plate 24, a supply plate 25, manifold plates 26, 27, and 28, a cover plate 29, and a nozzle plate 30.

The cavity plate 22 is made of metal, in which formed are a large number of substantially rhombic openings corresponding to the respective pressure chambers 10. The base plate 23 is made of metal, in which formed are communication holes for connecting the respective pressure chambers 10 of the cavity plate 22 with the corresponding apertures 12, and communication holes for connecting the respective pressure chambers 10 with the corresponding ink nozzles 8.

The aperture plate 24 is made of metal, in which formed are not only the apertures 12 but also communication holes for connecting the respective pressure chambers 10 with the corresponding ink nozzles 8. Each aperture 12 is formed of two holes and a half-etched region connecting the two holes. The supply plate 25 is made of metal, in which formed are communication holes for connecting the respective apertures 12 with the corresponding sub-manifold channels 5*a*, and communication holes for connecting the respective pressure chambers 10 with the corresponding ink nozzles 8. The manifold plates 26, 27, and 28 are made of metal, in which formed are not only holes that cooperate with each other to constitute the respective sub-manifold channels 5*a* when these plates are put in layers, but also communication holes for connecting the respective pressure chambers 10 with the corresponding ink nozzles 8. The cover plate 29 is made of metal, in which formed are communication holes for connecting the respective pressure chambers 10 of the cavity plate 22 with the corresponding ink nozzles 8. The nozzle plate 30 is made of metal, in which formed are the nozzles 8 that correspond to the respective pressure chambers 10 of the cavity plate 22.

Figure 9A:
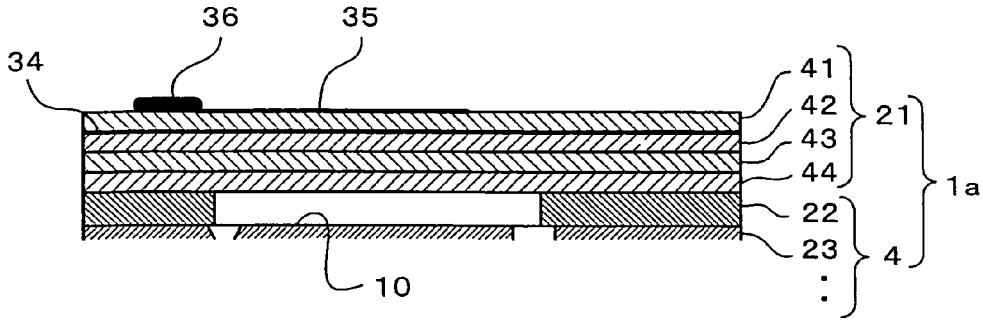
FIG. 9A is a local sectional view of an actuator unit illustrated in FIG. 7.

As illustrated in FIG. 9A, the actuator unit 21 is bonded onto the cavity plate 22 that constitutes the uppermost layer of the passage unit 4. The actuator unit 21 has a layered structure of four piezoelectric sheets 41, 42, 43, and 44 all made of a lead zirconate titanate (PZT)-base ceramic material having ferroelectricity. The four piezoelectric sheets 41 to 44 have the same thickness of approximately 15 μm, and so disposed as to span the many pressure chambers 10 formed within a single ink ejection region.

On the uppermost piezoelectric sheet 41, an individual electrode 35 is provided at a position corresponding to each pressure chamber 10. A common electrode 34 having a thickness of approximately 2 μm is interposed between the uppermost piezoelectric sheet 41 and the piezoelectric sheet 42 located thereunder. The common electrode 34 is provided throughout entire surfaces of these piezoelectric sheets. Both the individual electrodes 35 and the common electrode 34 are made of, e.g., an Ag—Pd-base metallic material. No electrode is disposed between the piezoelectric sheets 42 and 43, and between the piezoelectric sheets 43 and 44.

Figure 9B:
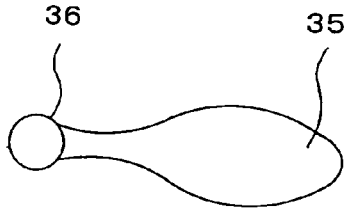
FIG. 9B is a plan view of an individual electrode that is disposed on a surface of the actuator unit in FIG. 9A.

As illustrated in FIG. 9B, the individual electrode 35 with a thickness of approximately 1 μm has, in a plan view, a substantially rhombic shape similar to the shape of the pressure chamber 10 (see FIG. 6). One acute portion of the substantially rhombic individual electrode 35 is elongated out. This elongation has, on its end, a circular land 36 having a diameter of approximately 160 μm. The land 36 is electrically connected with the individual electrode 35. The land 36 is made of, e.g., gold including glass frits, and bonded onto a surface of the elongation of the individual electrode 35, as illustrated in FIG. 9A. The land 36 is electrically bonded to a contact formed in the FPC 50.

The common electrode 34 is grounded in a non-illustrated region. Thus, the common electrode 34 is kept at the ground potential equally in a region corresponding to any pressure chamber 10. On the other hand, the individual electrodes 35 are connected to the driver IC 83 (see FIG. 2) via the corresponding lands 36 and the FPC 50 that includes different lead wires adapted for the respective individual electrodes 35 in order that the individual electrodes 35 corresponding to the respective pressure chambers 10 can be controlled in their potentials independently of one another.

Since the piezoelectric sheets 41 to 44 span the many pressure chambers 10 as described above, the individual electrodes 35 can be densely arranged on the piezoelectric sheet 41 using, e.g., a screen-printing technique. Therefore, the pressure chambers 10, which are positioned in correspondence with the individual electrodes 35, can also be densely arranged to thereby achieve a high-resolution image printing.

Here will be described how to drive the actuator unit 21.

In the actuator unit 21, the piezoelectric sheet 41 has been polarized in its thickness direction. In this state, when an individual electrode 35 is set at a different potential from that of the common electrode 34 to thereby apply an electric field to the piezoelectric sheet 41 in the polarization direction, a portion of the piezoelectric sheet 41 having the electric field applied thereto works as an active portion that distorts through a piezoelectric effect. The active portion is, due to transverse piezoelectric effect, going to extend or contract in its thickness direction and contract or extend in its plane direction. On the other hand, the other three piezoelectric sheets 42 to 44 are inactive layers having no region sandwiched between the individual electrode 35 and the common electrode 34, and therefore cannot deform by themselves.

That is, the actuator unit 21 has a so-called unimorph structure in which an upper piezoelectric sheet 41 remote from the pressure chambers 10 constitutes a layer including active portions and the lower three piezoelectric sheets 42 to 44 near the pressure chambers 10 constitute inactive layers.

As illustrated in FIG. 9A, a bottom of the piezoelectric sheets 41 to 44 is fixed onto a top face of the cavity plate 22 in which the pressure chambers 10 are defined. Accordingly, when a difference in distortion in the polarization direction is caused between the portion of the piezoelectric sheet 41 having the electric field applied thereto and the other piezoelectric sheets 42 to 44 located thereunder, the piezoelectric sheets 41 to 44 are as a whole deformed into a convex shape toward the corresponding pressure chamber 10, which is called "unimorph deformation". In association with this deformation, the volume of the pressure chamber 34 decreases and thus pressure of ink rises, so that the ink is ejected from the corresponding nozzle 8.

Then, when the individual electrode 35 is returned to the same potential as that of the common electrode 34, the piezoelectric sheets 41 to 44 restore their original flat shape, and thus the pressure chamber 10 also restores its original volume. Ink is accordingly introduced from the manifold channel 5 into the pressure chamber 10, which therefore stores the ink again.

According to the ink-jet head 1 of this embodiment, as described above, the passage unit 4 is supplied with ink from which foreign materials have already been removed by filter 70*f*. Therefore, a clogging of the nozzles 8 can be prevented. In the upper passage 75, air bubbles tend to stay in such an area on the plane of the filter 70*f* as to locate on the downstream side of the inkflow to be opposed to the inflow port 72*d*. However, the ink non-passing area N is formed in this area, and therefore air bubbles are prevented from staying in this area.

In the plane of the filter 70*f*, moreover, the location of the area opposed to the ink introduction port 71*b* is shifted away from the location of the area opposed to the inflow port 72*d*. Therefore, the relatively large filter 70*f* can be disposed in the introduction passage 77. This can prevent considerable lowering of a flow velocity of ink in the upper passage 75, even if a large amount of foreign materials accumulate on the filter 70*f*. Therefore, ink can flow toward the inflow port 72*d* in a relatively smooth manner, to realize smooth ink supply to the passage unit 4. In addition, since ink flows smoothly in the upper passage 75, air bubbles can, without staying on the filter 70*f*, be discharged into the inflow port 72*d*.

Within the introduction passage 77, ink flows vertically downward around the ink introduction port 71*b* and around the inflow port 72*d*, and flows along the filter 70*f* toward the inflow port 72*d* on both sides of the filter 70*f*. This construction can accept a larger filter 70*f* as compared with a construction in which ink flows in a single direction within the introduction passage 77. Accordingly, this construction provides the same effects as mentioned above, i.e., the effects that ink can smoothly be supplied to the passage unit 4 and that air bubbles are prevented from staying on the filter 70*f*.

In a plan view, the non-passing area N overlaps only a part of the inflow port 72*d*. When, in a plan view, the non-passing area N overlaps a whole of the inflow port 72*d*, the non-passing area. N may possibly obstruct inkflow running toward the inflow port 72*d*. This problem is, however, relieved in this embodiment. That is, the provision of the inkflow running vertically downward from the upper passage 75 toward the inflow port 72*d* can raise the ink velocity in the vicinity of the inflow port 72*d*. This enables air bubbles to be discharged into the inflow port 72*d* without staying on the filter 70*f*.

The non-passing area N extends vertically upward, continuously from the portion on the plane of the filter 70*f* including the point furthest from the ink introduction port 71*b* within the area opposed to the inflow port 72*d*. Air bubbles tend to stay particularly around the point furthest from the ink introduction port 71*b*, where the non-passing area N is however provided so that stay of air bubbles can effectively be suppressed.

A cross-sectional area of the lower passage 76, with respect to a plane perpendicular to the inkflow running along the filter 70*f* toward the inflow port 72*d*, is smallest at its portion adjacent to the inflow port 72*d*. With this construction, ink velocity rises at the downstream of the inkflow within the lower passage 76. This causes large suction force from the upper passage 75 to the lower passage 76, so that not only ink but also air bubbles can easily be brought into the lower passage 76. Accordingly, air bubbles are prevented from staying on the filter 70*f*. Moreover, an attempt to raise ink velocity by reducing the cross section of the passage often results in increased pressure loss and thus insufficient ink supply to the passage unit 4. According to the foregoing construction, however, ink velocity can be raised simultaneously with suppressing increase in pressure loss.

Further, since the filter 70*f* has lower filtration resistance at its portion nearer to the inflow port 72*d*, ink velocity rises at the downstream of the inkflow within the upper passage 75. As a result, not only ink but also air bubbles can easily be brought into the lower passage 76. Accordingly, air bubbles are prevented from staying on the filter 70*f*.

In the introduction passage 77, formed are the steps 70*s* and 70*t* that support thereon the outer edge portion of the filter 70*f*. This enables the filter 70*f* to be readily disposed.

In this embodiment, the non-passing area N is constituted of the block 70*b* disposed on the filter 70*f*. With this construction, the non-passing area N can be formed in a simple manner, and therefore the reservoir unit 70 can easily be manufactured.

The block 70*b* has a U-like shape with two tip ends and a curved portion, the two tip ends being directed toward the upstream of inkflow running above the filter 70*f*, and the curved portion being directed toward the downstream of the inkflow. Since the block 70*b* is shaped and disposed in this manner, ink velocity rises at the downstream of the inkflow within the upper passage 75. This enables air bubbles to be discharged into the inflow port 72*d* without staying on the filter 70*f*.

Figure 10:
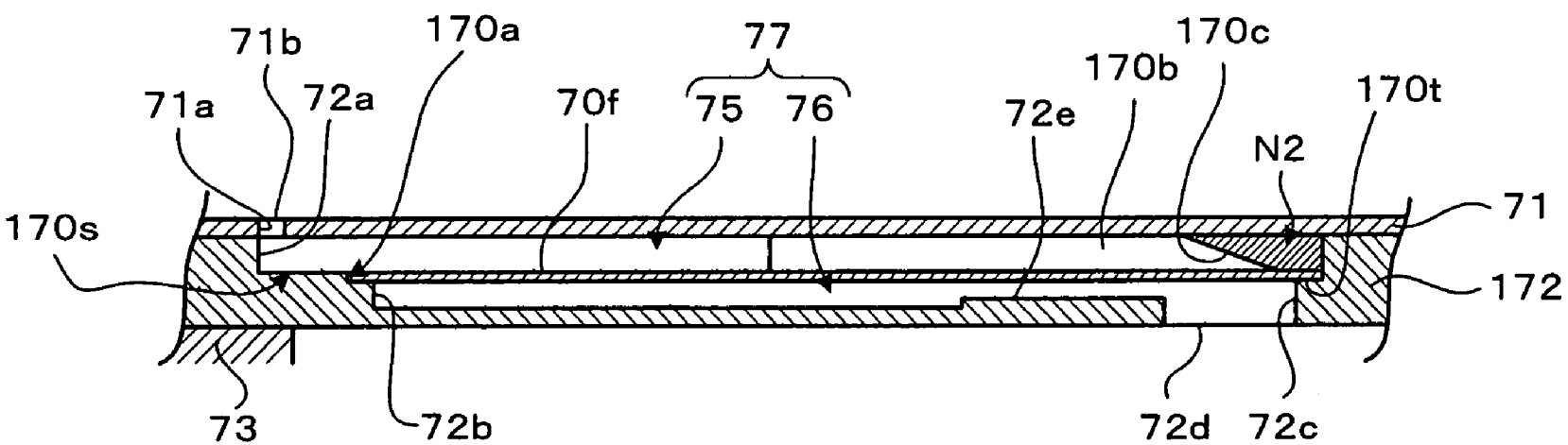
FIG. 10 is a local sectional view, taken along the line III—III of FIG. 1, of a reservoir unit used in an ink-jet head according to a second embodiment of the present invention.

Then, referring to FIG. 10, a description will be given to an ink-jet head according to a second embodiment of the present invention. This embodiment differs from the first embodiment only in construction of the filter plate of the reservoir unit, and the other members are the same as those of the first embodiment. In the following, the same members as described in the first embodiment will be denoted by the common reference numerals, without descriptions thereof.

In a filter plate 172 of this embodiment, steps 170*s* and 170*t*, which are similar to those of the first embodiment, are provided at a boundary between a first recess 72*a* and a second recess 72*b*. The step 170*s* provided on one longitudinal end side has, at its one end portion, a recess 170*a* which is absent from the first embodiment. The recess 170*a* is engageable with an outer edge portion of a filter 70*f*.

In this embodiment, the provision of the recess 170*a* allows easy positioning of the filter 70*f*. More specifically, the filter 70*f* is disposed such that its outer edge portion at one end can engage with the recess 170*a* and its outer edge portion at the other end can be supported on the step 170*t* while contacting with a sidewall of a first recess 72*a*.

Without the recess 170*a*, an adhesive for bonding the filter 70*f* is put on a surface of the step 170*s*, and this adhesive may obstruct inkflow to thereby cause air bubbles to stay on the filter 70*f*. In this embodiment, however, since an adhesive can be put within the recess 170*a*, the adhesive causes no obstruction to inkflow. Therefore, stay of air bubbles is suppressed.

A depth of the recess 170*a* is equal to a thickness of the filter 70*f*, so that a top face of the filter 70*f* and a top face of the step 170*s* locate on the same plane. With this construction, ink flows smoothly above the step 170*s*, and therefore stay of air bubbles can be suppressed more.

A block 170*b* disposed on the filter 70*f* has a U-like planer shape similar to that of the first embodiment. In the block 170*b* of this embodiment, however, a curved portion has a tapered surface 170*c*. The tapered surface 170*c* locates in an area opposed to an inflow port 72*d* in a vertical direction. The tapered surface 170*c* is inclined with respect to a plane of the filter 70*f* so as to be more distant from the filter 70*f* as approaching to the ink introduction port 71*b* along the filter 70*f*, i.e., from right to left in FIG. 10. Thus, an ink non-passing area N2 of this embodiment is different from that of the first embodiment shown in FIG. 3.

At the downstream of inkflow within the upper passage 75, ink flows along the tapered surface 170*c* to be smoothly guided into the inflow port 72*d*. Therefore, air bubbles are further restrained from staying on the filter 70*f*.

Figure 11:
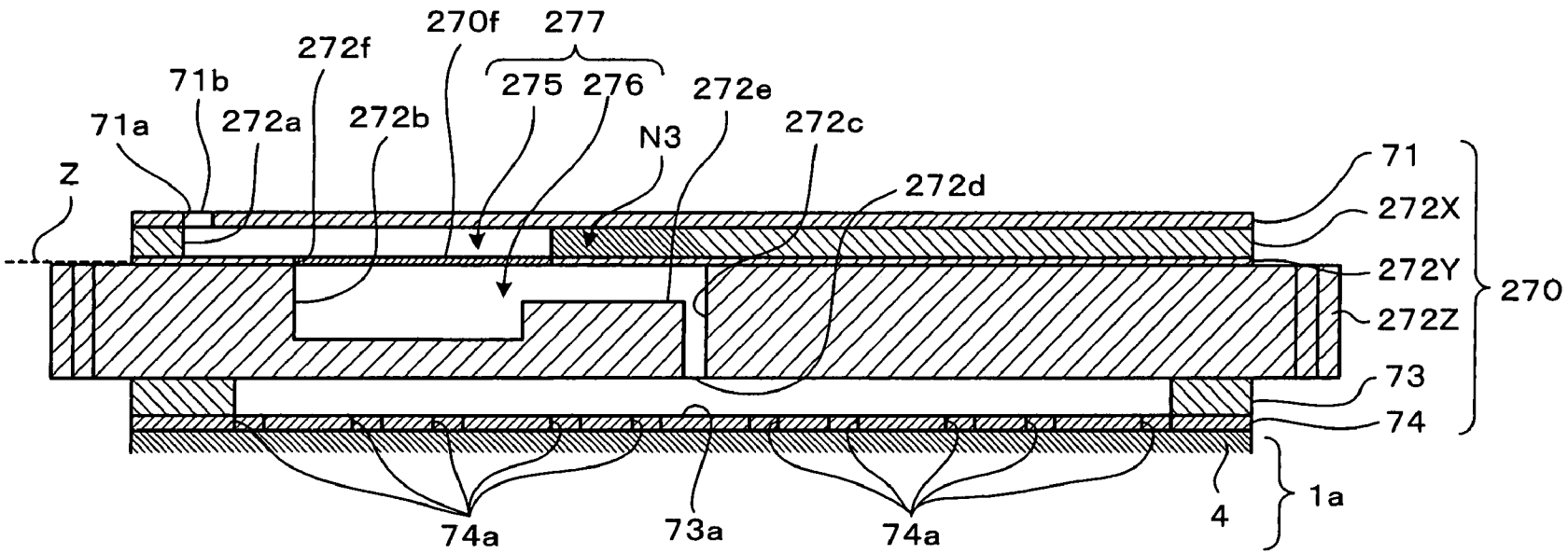
FIG. 11 is a local sectional view, taken along the line III—III of FIG. 1, of a reservoir unit used in an ink-jet head according to a third embodiment of the present invention.

Then, referring to FIGS. 11 and 12, a description will be given to an ink-jet head according to a third embodiment of the present invention. This embodiment differs from the first embodiment in construction of the reservoir unit, and the other members are the same as those of the first embodiment. In the following, the same members as described in the first embodiment will be denoted by the common reference numerals, without descriptions thereof. For the purpose of explanatory convenience, FIG. 11 is, similarly to FIG. 3, drawn on an enlarged scale in the vertical direction.

A reservoir unit 270 has a layered structure of an upper plate 71, filter plates 272X, 272Y, and 272Z, a reservoir plate 73, and an under plate 74, each of which has a plane of substantially rectangular shape elongated in the main scanning direction (see FIG. 1). Although the filter plate is formed of a single plate in the above-described embodiments, the filter plate is formed of three plates in this embodiment. In the following, the three filter plates 272X to 272Z (hereinafter referred to as, from a top, a first filter plate, a second filter plate, and a third filter plate) will be described in sequence.

Figure 12:
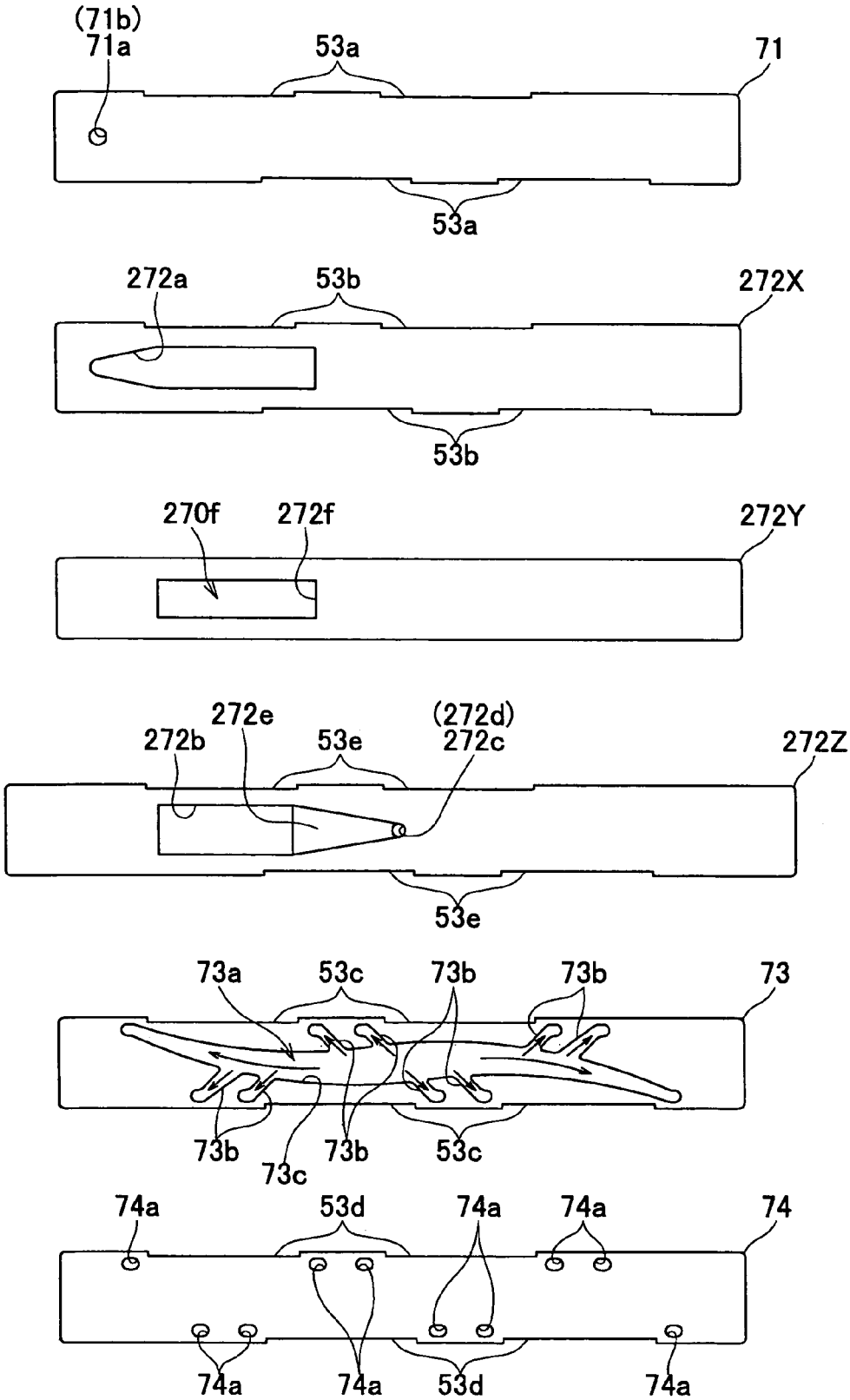
FIG. 12 is an exploded plan view of the reservoir unit illustrated in FIG. 11.

As illustrated in FIG. 12, the first filter plate 272X has, at its both widthwise ends, a total of four rectangular notches 53*b* formed in a staggered pattern, and also has, at its one longitudinal end portion, a through-hole 272*a* whose length is approximately one-third of a length of the first filter plate 272X. The hole 272*a* is, in a plan view, elongated from a portion corresponding to a hole 71*a* to a center of the plate. A portion of the hole 272*a* corresponding to the hole 71*a* is shaped in conformity with a shape of the hole 71*a*. The hole 272*a* has a wedge-like shape widening toward the center into substantially half a width of the plate, to form, at a center-side portion thereof, a rectangular shape having substantially half the width of the plate. This hole 272*a* constitutes an upper passage 275 of the introduction passage 277 (see FIG. 11).

In the second filter plate 272Y, as illustrated in FIG. 12, a through-hole 272*f* is formed to correspond to a region of the hole 272*a* except for its wedge-shaped portion, i.e., corresponds to a rectangular region of the hole 272*a*. A filter 270*f* is disposed within the hole 272*f*. The plate 272Y has no notch formed at its widthwise ends, and its width is smaller than a width of the other plates 272X and 272Z by the extent corresponding to the notch.

The third filter plate 272Z has, at its both widthwise ends, a total of four rectangular notches 53*e* formed in a staggered pattern, and also has, in its top face, a recess 272*b* made up of a rectangular region and a substantially triangular region. The rectangular region corresponds to a portion of the through-hole 272*f* from its one end to approximately two-third of its length. A hole 272*c* is set at a top of the substantially triangular region. At almost a center of the plate 272Z, the hole 272*c* having a substantially circular shape penetrates through the plate 272Z in its thickness direction. The hole 272*c* communicates with the recess 272*b*, and at the same time forms an inflow port 272*d* opening out in a lower face of the plate 272Z.

As illustrated in FIG. 11, a depth of the rectangular region of the recess 272*b* is approximately two-third of a thickness of the plate 272Z, and a depth of the substantially triangular region of the recess 272*b* is approximately one-third of the thickness of the plate 272Z. Thus, a protrusion 272*e* similar to the protrusion 72*e* (see FIG. 3) of the first embodiment appears on a bottom face of the recess 272*b*. The recess 272*b* and the hole 272*c* located below the filter 270*f* constitute a lower passage 276.

In this embodiment, even without the block 70*b* and 170*b* as in the first and second embodiments, an ink non-passing area N3 is formed in an area on a plane of the filter 270*f* opposed to the inflow port 272*d*. Like this, since the ink non-passing area N3 is formed at the portion where air bubbles tend to stay, stay of air bubbles can be prevented similarly to the first embodiment.

In the first and second embodiments, the upper passage 75 and the lower passage 76 are formed in the single plate 72 or 172. In this embodiment, however, the upper passage 275 and the lower passage 276 are formed in the separate plates 272X and 272Z, respectively. The passages can accordingly be formed in a simple manner, thereby facilitating a manufacturing of the reservoir unit 270 as well.

In the first and second embodiments, the non-passing area N or N2 overlaps only a part of the inflow port 72*d* in a plan view, but alternatively it may overlap a whole of the inflow port 72*d* in a plan view. In the third embodiment, the non-passing area N3 overlaps a whole of the inflow port 272*d* in a plan view, but alternatively it may overlap only a part of the inflow port 272*d* in a plan view.

It is not always required that the inkflow within the introduction passage 77 or 277 runs vertically downward around the ink introduction port 71*b* and around the inflow port 72*d* or 272*d*, but the inkflow may run obliquely downward therearound.

In the first to third embodiments, a cross-sectional area of the lower passage 76 or 276, with respect to a plane perpendicular to the inkflow running along the filter 70*f* or 270*f* toward the inflow port 72*d* or 272*d*, is smallest at its portion adjacent to the inflow port 72*d* or 272*d*. This however is not limitative, and the second recess 72*b* or 272*b* may have a flat bottom face with no protrusion 72*e* or 272*e* formed thereon, for example.

Although, in the first embodiment, the filter 70*f* has lower filtration resistance at its portion nearer to the inflow port 72*d*, this is not limitative. The filter 70*f* may have uniform filtration resistance throughout its whole area, or alternatively may have higher filtration resistance at its portion nearer to the inflow port 72*d*.

In the first and second embodiments, a U-shaped block is employed as the block 70*b* or 170*b* that forms the non-passing area N and N2. However, an otherwise-shaped block may also be employed.

It is not always necessary to provide the ink non-passing areas N, N2, and N3 nor to vary the filtration resistance of the filter 70*f*, as long as a cross-sectional area of the lower passage 76 or 276, with respect to a plane perpendicular to the inkflow running along the filter 70*f* or 270*f* toward the inflow port 72*d* or 272*d*, is smallest at its portion adjacent to the inflow port 72*d* or 272*d*.

As long as the filter 70*f* or 270*f* has lower filtration resistance at its portion nearer to the inflow port 72*d*, it is not always required that the ink non-passing areas N, N2, and N3 are provided, nor that the cross-sectional area of the lower passage 76 or 276 with respect to the aforementioned plane is smallest at its portion adjacent to the inflow port 72*d* or 272*d*.

An application of the present invention is not limited to ink-jet printers. The present invention is applicable also to, for example, ink-jet type facsimile or copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit that includes a common ink chamber and a plurality of individual ink passages each extending from the common ink chamber through a pressure chamber to a nozzle, and a reservoir unit that is fixed to the passage unit and includes an ink reservoir which stores ink;

wherein the reservoir unit includes:

an introduction passage that connects an ink introduction port into which ink is introduced and an inflow port, one or more discharge passages that communicate the ink reservoir with the common ink chamber, and a filter that extends along a plane within the introduction passage so as to divide the introduction passage into an upper passage and a lower passage;

wherein the introduction passage has such a configuration in the introduction passage that constricts the ink flow so that, on both sides of the filter, ink can flow along the filter toward the inflow port; and wherein the flow is constricted in the introduction passage by an ink non-passing area formed within the introduction passage, the ink non-passing area extending continuously, from at least a part of an area on the plane opposed to the inflow port, in a direction away from the inflow port in the introduction passage.

2. The ink-jet head according to claim 1, wherein a location of an area on the plane opposed to the ink introduction port is shifted away from a location of the area on the plane opposed to the inflow port.

3. The ink-jet head according to claim 1, wherein ink introduced into the ink introduction port flows downward in a direction perpendicular to the plane, into the upper passage, then, within the upper passage, flows along the filter toward the inflow port, and passes through the filter to flow into the lower passage, and then, within the lower passage, flows along the filter toward the inflow port, around which the ink flows downward in the direction perpendicular to the plane.

4. The ink-jet head according to claim 1, wherein the ink reservoir extends in parallel to the plane.

5. The ink-jet head according to claim 1, wherein the non-passing area extends continuously, from only a part of the area on the plane opposed to the inflow port, in a direction away from the inflow port.

6. The ink-jet head according to claim 1, wherein the non-passing area extends continuously, from a portion on the plane including at least a point furthest from the ink introduction port within the area opposed to the inflow port, in the direction away from the inflow port.

7. The ink-jet head according to claim 1, wherein a cross-sectional area of the lower passage, with respect to a plane perpendicular to an inkflow running along the filter toward the inflow port, is smallest at its portion adjacent to the inflow port.

8. The ink-jet head according to claim 1, wherein the filter has lower filtration resistance at its portion nearer to the inflow port.

9. The ink-jet head according to claim 1, wherein the reservoir unit has a tapered area including a tapered surface formed integrally with the non-passing area, the tapered surface being inclined with respect to the plane so as to be more distant from the plane as approaching to the ink introduction port along the filter.

10. The ink-jet head according to claim 1, wherein a step that supports thereon an outer edge portion of the filter is formed within the introduction passage.

11. The ink-jet head according to claim 10, wherein the step has, at its end portion, a recess engageable with the outer edge portion of the filter.

12. The ink-jet head according to claim 11, wherein a depth of the recess is equal to a thickness of the filter.

13. The ink-jet head according to claim 1, wherein the ink non-passing area is constituted of a block disposed on the filter.

14. The ink-jet head according to claim 13, wherein the block has a U-like shape with two tip ends and a curved portion, the two tip ends being directed toward an upstream of an inkflow above the filter, and the curved portion being directed toward a downstream of the inkflow.

15. An ink-jet head comprising:

a passage unit that includes a common ink chamber and a plurality of individual ink passages each extending from the common ink chamber through a pressure chamber to a nozzle, and a reservoir unit that is fixed to the passage unit and includes an ink reservoir which stores ink;

wherein the reservoir unit includes:

an introduction passage that connects an ink introduction port into which ink is introduced and an inflow port which faces the ink reservoir, one or more discharge passages that communicate the ink reservoir with the common ink chamber, and a filter that extends along a plane within the introduction passage so as to divide the introduction passage into an upper passage and a lower passage;

wherein the introduction passage has such a configuration in the introduction passage that constricts the ink flow so that, on both sides of the filter, ink can flow along the filter toward the inflow port; and wherein the flow is constricted in the introduction passage by a cross-sectional area of the lower passage, with respect to a plane perpendicular to an inkflow running along the filter toward the inflow port, being smallest at its portion adjacent to the inflow port in the introduction passage.

16. An ink-jet head comprising:

a passage unit that includes a common ink chamber and a plurality of individual ink passages each extending from the common ink chamber through a pressure chamber to a nozzle, and a reservoir unit that is fixed to the passage unit and includes an ink reservoir which stores ink;

wherein the reservoir unit includes:

an introduction passage that connects an ink introduction port into which ink is introduced and an inflow port which faces the ink reservoir, one or more discharge passages that communicate the ink reservoir with the common ink chamber, and a filter that extends along a plane within the introduction passage so as to divide the introduction passage into an upper passage and a lower passage;

wherein the introduction passage has such a configuration in the introduction passage that constricts the ink flow so that, on both sides of the filter, ink can flow along the filter toward the inflow port; and wherein the flow is constricted in the introduction passage by the filter having a lower filtration resistance at its portion nearer to the inflow port in the introduction passage.

* * * * *